US005825269A

United States Patent [19]

Koppmann

[11] Patent Number: 5,825,269

[45] Date of Patent: Oct. 20, 1998

[54] ELECTROMAGNETIC SWITCHGEAR

[75] Inventor: Bardo Koppmann, Kaltenbrunn/Bundesrepublik, Germany

[73] Assignee: Siemens Aktiengesellschaft, München, Germany

[21] Appl. No.: 647,975

[22] PCT Filed: Nov. 18, 1994

[86] PCT No.: PCT/DE94/01362

§ 371 Date: Jun. 3, 1996

§ 102(e) Date: Jun. 3, 1996

[87] PCT Pub. No.: WO95/15574

PCT Pub. Date: Jun. 8, 1995

[30] Foreign Application Priority Data

Dec. 3, 1993 [DE] Germany ..... 43 41 330.7

[51] Int. Cl.[6] ..... H01H 67/02

[52] U.S. Cl. ..... 335/132; 335/202

[58] Field of Search ..... 200/305, 295–304; 335/132, 202

[56] References Cited

U.S. PATENT DOCUMENTS

| | | | |
|---|---|---|---|
| 3,728,506 | 4/1973 | Hoebler et al. . | |
| 3,992,599 | 11/1976 | Halbach . | |
| 5,218,332 | 6/1993 | Blanchard et al. | 335/132 |
| 5,235,303 | 8/1993 | Xiao | 335/132 |
| 5,293,521 | 3/1994 | Blanchard et al. . | |
| 5,296,826 | 3/1994 | Hart et al. | 335/132 |
| 5,300,905 | 4/1994 | Kolbas et al. | 335/132 |
| 5,300,906 | 4/1994 | Blanchard et al. | 335/132 |
| 5,546,062 | 8/1996 | Duchemin | 335/105 |
| 5,652,420 | 7/1997 | Innes et al. | 200/50.32 |

FOREIGN PATENT DOCUMENTS

| | | |
|---|---|---|
| 0 515 731 | 12/1992 | European Pat. Off. . |
| 0 547 928 | 6/1993 | European Pat. Off. . |
| 34 02 836 | 8/1985 | Germany . |

*Primary Examiner*—Lincoln Donovan
*Attorney, Agent, or Firm*—Kenyon & Kenyon

[57] ABSTRACT

An electromagnetic switchgear having an explosion chamber that can be removed from its bottom part and a bridge support that projects into the area of the explosion chamber and bears movable contact parts. In order to safely lock by simple means the contact support when the explosion chamber has been removed, locking means and the explosion chamber are specially designed with means that make the locking means slide in a link into a position where the contact support is unlocked when the explosion chamber is connected to the bottom part of the switchgear.

4 Claims, 3 Drawing Sheets

ELECTROMAGNETIC SWITCHGEAR

FIELD OF THE INVENTION

The present invention relates to an electromagnetic switchgear, and in particular a contractor.

BACKGROUND INFORMATION

An electromagnetic switchgear is described in German Patent No. 34 02 836, where locking means which are activated depending on the explosion chamber connection with the bottom part are provided for the movement of the contact bridge support. At least the switch-on of the switchgear is avoided in this manner when the explosion chamber is removed. The locking means consist of, for example, a spring-loaded latch that is pushed back by the contour of the explosion chamber. Another variation of the electromagnetic switchgear described in the above-mentioned German Patent involves the use of a locking bar in the bottom part which locking bar can be moved at right angles to the direction of movement of the contact bridge support and which can be moved into the locking position depending on the connecting member between the explosion chamber and the bottom part. The actuation of the locking bar takes place, for example, in that the connecting member is a fastening screw whose conical tip engages with a control opening of the locking bar which is spring-loaded in the locking direction.

European Patent Application No. 0 515 731 describes an electromagnetic switchgear in which the contact bridge support remains safely locked with the housing when the explosion chamber is removed even when shaken or impacted and in which the locking bar can always be fully released by the fastening element of the explosion chamber with reliability and without intermediate positions. In the above-mentioned European Patent Application, the locking bar accommodated in the housing in a guided manner locks the contact support under the action of a spring. The locking bar can be held against the spring force in the unlocked position by way of the fastening element used of the explosion chamber, the explosion chamber being put on during operation. The spring causes the locking bar to safely lock the contact support in the housing when the fastening element is removed even when shaken or impacted. Intermediate positions are practically excluded. Here, the locking bar is rotatably supported in the housing and can grip from behind and retain in the locked position a part of the contact bridge support.

European Patent Application No. 0 547 928 describes a contactor in which an electomagnet that opens and closes the switching contacts can be actuated manually via a push-button. By actuating the push-button, a flap is carried along, an opening in the housing being released or sealed as a result. The intermediate links slide on one another with different directions of movement. The locking action takes place here via two corner elements having a slanted edge contour. Moreover, a rotatable locking bar having a torsion spring is used as a locking means.

U.S. Pat. No. 3,728,506 describes an electromagnetic switchgear in which locking means are designed as a slide bar, the explosion chamber of the switchgear having a contour adapted to the slide bar.

An object of the present invention is to create an electromagnetic switchgear that with a simple design guarantees that the contact bridge support is safely locked when the explosion chamber has been removed. This objective is achieved in that means are provided on the locking means and on the explosion chamber by way of which the locking means slide in a link into a position where the contact bridge support is unlocked when the explosion chamber is connected to the bottom part. An advantageous embodiment of the present invention is achieved if the locking means are designed as a slide bar having a slanted edge contour as means and if the explosion chamber has a contour adapted to this intended for engagement. Moreover, it is advantageous if the locking means are designed as a rotatable locking bar which is held by a torsion spring in the locking position, and if the locking bar is provided with a slanted contact surface by way of which the locking bar can be rotated into a position unlocking the contact bridge support while engaging with a contour of the explosion chamber which is adapted for such purpose.

DETAILED DESCRIPTION

Figure 1:
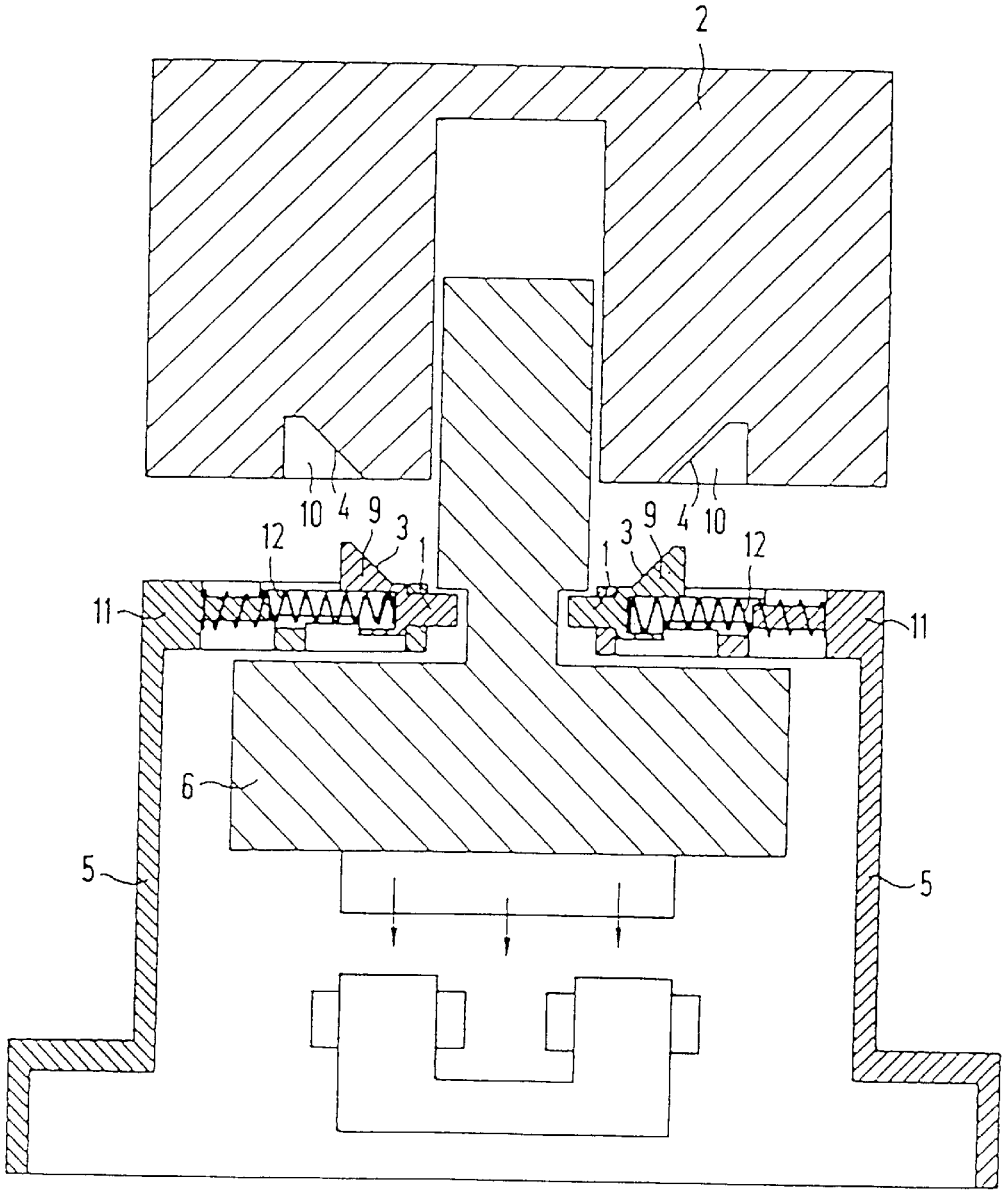
FIG. 1 shows a switchgear having a slide bar for locking a contact support member according to the present invention.
Figure 2:
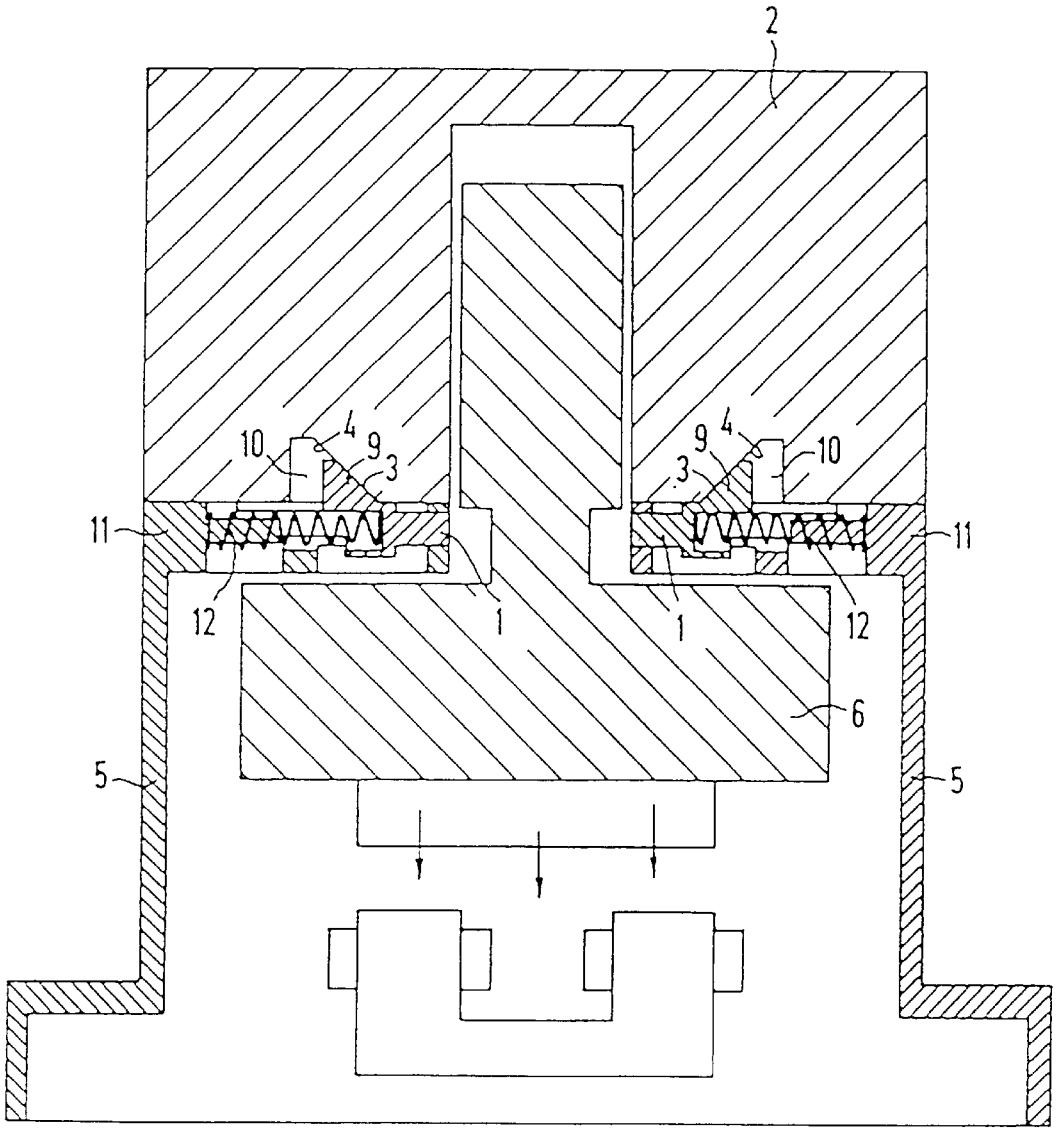
FIG. 2 shows the switchgear with an unlocked contact bridge support according to the present invention.

The switchgear shown in FIG. 1 has a bottom part 5 in which the non-switching magnetic part with the coil as well as the switching magnetic part (not shown) with the contact bridge support 6 that projects into the area of the explosion chamber 2 are housed. The explosion chamber 2 is removed here. Slide bars 1 lying in the housing wall 11 of the bottom part 5 are brought into a position locking the contact support 6 by a compression spring 12. The locking bars 1 are provided on their top side with projections 9. As shown in FIG. 1, they are formed triangularly, i.e., they have a slanted edge contour. The explosion chamber 2 is provided with recesses 10 slightly offset from the projections 9, which recesses 10 have an inner contour 4 which is adapted to the slanted edge contour 3. The two contours 3,4 slide on one another when the explosion chamber 2 is put on the bottom part 5 in a link-like manner, the slide bars 1 being shifted outwards contrary to the spring force of the compression spring 12 and thus releasing the contact bridge support 6, as is shown in FIG. 2. Here, the projections 9 are inserted into the recesses 10 of the explosion chamber 2.

Figure 3:
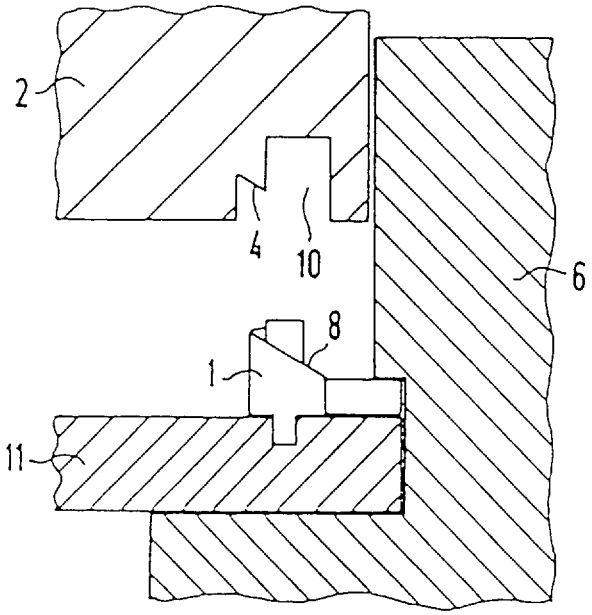
FIG. 3 shows another embodiment of the switchgear using a rotatably supported locking bar according to the present invention.
Figure 4:
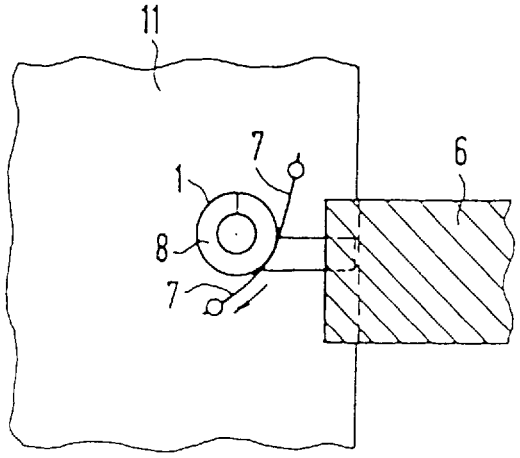
FIG. 4 shows a top view of the rotatably supported locking bar illustrated in FIG. 3.

In another embodiment of the present invention shown in a rotatable locking bar 1 is used instead of the lengthwise movable locking bar 1. The rotatable locking bar 1 is held, for example, as shown by FIG. 3, in the housing wall 11 and has a slanted contact surface 8. The locking bar 1 is held according to FIG. 4 by a torsion spring 7 in the position locking the contact bridge support 6. The explosion chamber 2 has a recess 10 for receiving the locking bar 1 when it is put on the bottom part 5. In this process, the rotatable locking bar 1 enters into the recess 10 and an inner contour 4 of the recess 10 adapted to the contact surface 8 slides along the contact surface 8 while the locking bar 1 is turned so that the locking bar 1 is brought into a position unlocking the contact bridge support 6 contrary to the spring force of the torsion spring 7.

What is claimed is:

1. An electromagnetic switchgear comprising:

an explosion chamber;

a bottom member; and a contact bridge support member projecting through an opening in an upper wall of the bottom member into the explosion chamber, wherein the bottom member includes a locking member for automatically locking the contact bridge support member when the explosion chamber is displaced from the bottom member, the locking member including a projection having a first contour surface, the first contour surface substantially facing a second contour surface of the explosion chamber for flatly engaging the second contour surface of the explosion chamber, the first contour surface and the second contour surface flatly sliding on each other when the explosion chamber is connected to the bottom member so as to cause the locking member to unlock the contact bridge support member when the explosion chamber is connected to the bottom member.

2. The electromagnetic switchgear according to claim 1, wherein the locking member includes a slide bar, the slide bar including the projection having the first contour surface and wherein the first and second contour surfaces are slanted.

3. The electromagnetic switchgear according to claim 1, wherein the locking member includes a rotatable locking bar, the rotatable locking bar being held by a torsion spring when the contact bridge support member is locked, the rotatable locking bar including the projection having the first contour surface and wherein the first and second contour surfaces are slanted.

4. The electromagnetic switchgear according to claim 1, wherein the electromagnetic switchgear is a contactor.

* * * * *